US005993096A

United States Patent [19]

Martelli

[11] Patent Number: 5,993,096

[45] Date of Patent: Nov. 30, 1999

[54] RECEPTACLE AND APPLICATOR FOR PRINTERS' INK

[76] Inventor: John D. Martelli, 321 S. 61st Ave., Pensacola, Fla. 32506

[21] Appl. No.: 08/900,509

[22] Filed: Jul. 25, 1997

[51] Int. Cl.[6] ..... B65D 88/34

[52] U.S. Cl. ..... 401/126; 401/130; 401/139; 401/191; 220/578

[58] Field of Search ..... 401/118, 122, 401/126, 127, 130, 139, 141, 142, 191; 220/216, 578, 287, 735, 736, 697

[56] References Cited

U.S. PATENT DOCUMENTS

| | | | |
|---|---|---|---|
| 888,756 | 5/1908 | Scranton | 401/130 |
| 2,167,619 | 8/1939 | Bainton | 220/578 |
| 2,227,172 | 12/1940 | Bainton | 220/578 |
| 2,456,912 | 12/1948 | Burrows | 220/287 |
| 2,465,755 | 3/1949 | Sanders | 220/578 |
| 2,556,195 | 6/1951 | Kors | 220/578 |
| 3,164,289 | 1/1965 | Cocchiarella | 220/578 |
| 3,266,662 | 8/1966 | Craig | 220/578 |
| 3,719,306 | 3/1973 | Holtzman | 220/578 |
| 5,117,998 | 6/1992 | Handzel | 220/578 |
| 5,249,692 | 10/1993 | Gunderson | 220/578 |
| 5,392,949 | 2/1995 | McKenna | 220/287 |

FOREIGN PATENT DOCUMENTS

| | | | |
|---|---|---|---|
| 2306136 | 10/1976 | France | 220/287 |

*Primary Examiner*—Charles R. Eloshway
*Attorney, Agent, or Firm*—George A. Bode; Bode & Associates

[57] ABSTRACT

An applicator and receptacle sealer, the applicator for applying a viscous liquid stored in a receptacle and the sealer for sealing the receptacle which is open at the top for removal of the liquid, the applicator and receptacle sealer comprising: a substantially circular member of a flexible, semi-rigid material having a diameter which is selectively adjustable and having a marginal annular edge for sealably engaging the interior wall of a receptacle, the selectively adjustable diameter of the circular member formed by providing annularly in the marginal annular edge scored lines for removing a selected outer portion of the marginal annular edge from the circular member, thereby reducing the diameter of the circular member; and, an elongated handle member mounted to the upper surface of the circular member for imparting vertical movement thereto when the circular member is positioned within the receptacle. The lower surface of said circular member can have an affinity for the viscous liquid to allow the liquid to adhere to the surface and be removed from the receptacle and deposited for its intended use.

15 Claims, 1 Drawing Sheet

RECEPTACLE AND APPLICATOR FOR PRINTERS' INK

BACKGROUND OF THE INVENTION

1. Field of the Invention

The present invention relates to an apparatus for sealing receptacles and applying the contents therein and, more particularly, to a receptacle and applicator for printers' ink which allows for the adjustment of the size of the applicator to fit the container (without any special tools) and sealing of the container by the applicator after each use without the need for a special sealing cap, thereby minimizing the amount of time to supply the ink to its end use and minimizing the amount of ink wasted.

2. General Background

In the printing industry, ink comes in containers of many differing sizes and must be poured into the reservoirs of printing machines by using a ladle as the ink has a high viscosity. Seldom is a full container used thus requiring that the container be resealed or the ink will develop a crust at the top wasting a good portion of the ink which is quite expensive. This problem is exacerbated because there is no one standard sized container industry-wide so that one sealing cap or applicator can be used.

Several attempts have been made at sealing receptacles containing liquids and/or providing an applicator therefor. However, none of these prior devices allow for a universal applicator and receptacle sealer for printers' ink or like viscous material.

U.S. Pat. No. 2,465,755 issued to F. A. Sanders; U.S. Pat. No. 1,525,785 issued to G. W. Ullman; and, U.S. Pat. No. 1,092,902 issued to D. Doggett, all disclose containers for printers' ink which have "floating" lids which prevent air from contacting the ink's surface during storage. U.S. Pat. No. 3,221,359 issued to R. Moroni, at al.; U.S. Pat. No. 888,756 issued to E. M. Scranton; and, U.S. Pat. No. 1,534,259 issued to J. D. Dempsey, all disclose containers for viscous materials (such as glue, polish, etc.) which have lids with applicators on the under surfaces thereof that snugly fit inside containers to cover the substances therein. U.S. Pat. No. 3,164,289 issued to T. A. Cocchiarella; U.S. Pat. No. 2,828,886 issued to R. W. Thomas; and, U.S. Pat. No. 1,284,751 issued to M. Mussino, all disclose containers which have sealable lids, the edges of the lids contacting the inner walls of the containers; each has a handle affixed to the upper surface of its "floating" lid.

SUMMARY OF THE PRESENT INVENTION

The preferred embodiment of the present invention solves the aforementioned problems in a straight forward and simple manner. What is provided is an applicator and receptacle sealer, the applicator for applying a viscous liquid stored in a receptacle and the sealer for sealing the receptacle which is open at the top for removal of the liquid, the applicator and receptacle sealer comprising: a substantially circular member of a flexible, semi-rigid material having a diameter which is selectively adjustable and having a marginal annular edge for sealably engaging the interior wall of the receptacle, the selectively adjustable diameter of the circular member formed by providing annularly in the marginal annular edge scored lines for removing a selected outer portion of the marginal annular edge from the circular member, thereby reducing the diameter of the circular member; and, an elongated handle member mounted to the upper surface of the circular member for imparting vertical movement thereto when the circular member is positioned within the receptacle. The lower surface of said circular member has an affinity for the viscous liquid to allow the liquid to be removed from the receptacle and deposited for its intended use.

In view of the above, it is an object of the present invention to provide a universal or "one size fits all" applicator and sealer for printers' ink and containers thereof.

Another object of the present invention is to provide an applicator that moves easily within the liquid receptacle yet seals the receptacle.

In view of the above objects, it is a feature of the present invention to provide an applicator and sealer which is easy to use.

It is another feature of the present invention to provide an applicator and sealer which is inexpensive to manufacture.

A further feature of the present invention is to provide an applicator and sealer which is made of a lightweight non-rigid material such as rubber or soft plastic or plastic-like material.

The above and other objects and features of the present invention will become apparent from the drawing, the description given herein, and the appended claims.

BRIEF DESCRIPTION OF THE DRAWING

For a further understanding of the nature and objects of the present invention, reference should be had to the following description taken in conjunction with the accompanying drawings in which like parts are given like reference numerals and, wherein.

DETAILED DESCRIPTION OF THE PREFERRED EMBODIMENT

Figure 1:
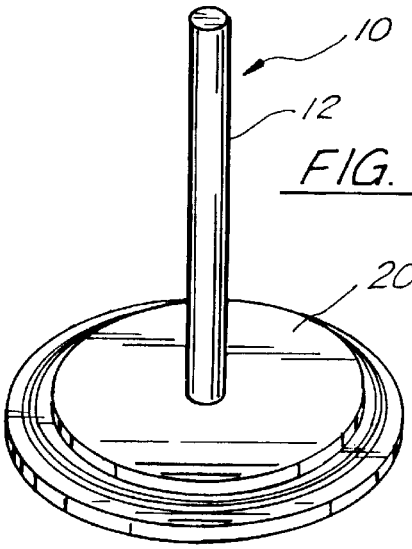
FIG. 1 is a top perspective view of the preferred embodiment of the applicator and sealer for a receptacle of printers' ink of the present invention.
Figure 3:
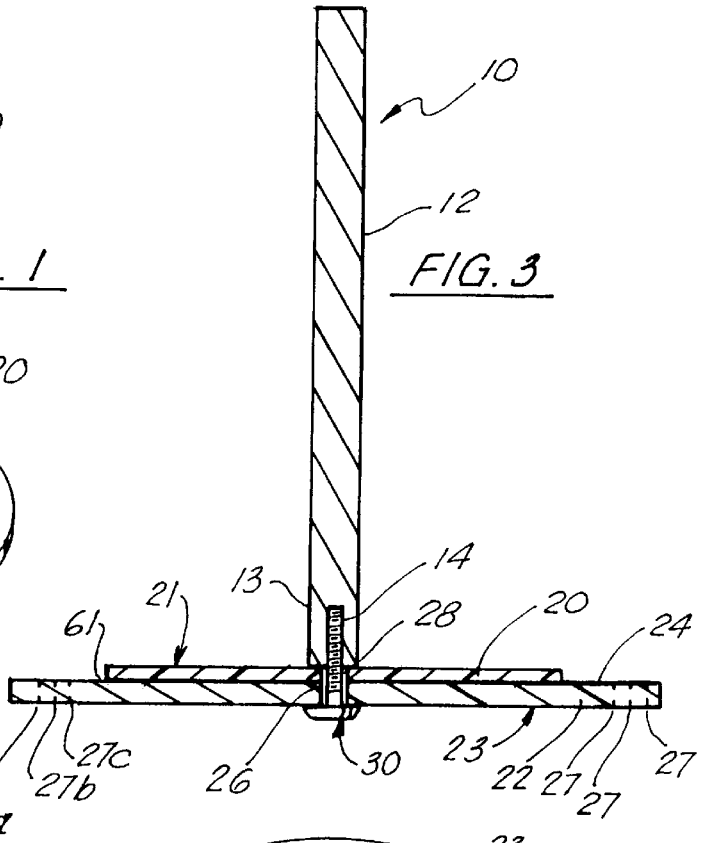
FIG. 3 is a cross-sectional side view of the embodiment of FIG. 1.
Figure 2:
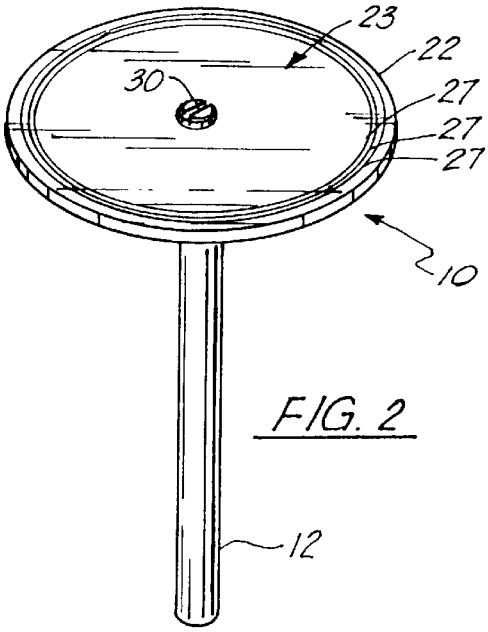
FIG. 2 is a bottom perspective view of the embodiment of FIG. 1.

Referring now to the drawing, and in particular FIGS. 1–3, the applicator and receptacle sealer of the present invention is designated generally by the numeral 10. Apparatus 10 comprises a substantially circular member or first disc 22 of a flexible, semi-rigid material such as rubber or soft plastic so that it will bend at its marginal annular edge 24. A central aperture 26 is provided in disc 22. The diameter of disc 22 and thus, the area of marginal annular edge 24, is selectively adjustable by means to be described further herein. An elongated handle 12 is mounted to the upper surface of a substantially circular member or second disc 20 and this combination is mounted to the upper surface of disc 22 by any conventional fastening means such as threaded bolt 30 or riveting, gluing, etc. In the preferred embodiment, and as best seen in FIGS. 2 and 3, handle 12 is integrally formed with disc 20 and of some rigid material such as wood, metal or hard rubber or hard plastic. In the lower portion 13 of handle 12 is provided a threaded counter-sunk bore 14. A central aperture 28 is provided through disc 20. This bore 14 and aperture 28 align to form a common bore which accepts threaded bolt 30, thus fastening handle 12 and disc 20 to disc 22.

Figure 4:
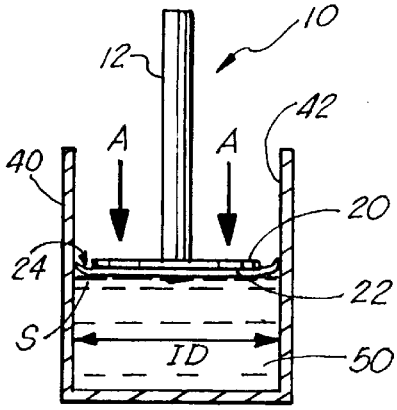
FIG. 4 is a side view illustrating the applicator and sealer of the embodiment of FIG. 1 used in an open receptacle for printers' ink.

As best seen in FIGS. 1, 3 and 4, disc 20 is of diameter less than the diameter of disc 22, thereby defining marginal annular edge 24 for sealably engaging the interior wall 42 of receptacle 40 which contains printers' ink 50 or some other viscous material.

As best seen in FIGS. 1–3, circular member or disc 22 is provided with means for selectively adjusting its diameter which comprises spaced-apart annular serrated grooves or scored lines 27 positioned concentrically in marginal annular edge 24. As will be discussed more fully herein, the separation of the outer portion 25 of the marginal annular edge 24 from disc 22 along scored line 27*a* reduces the diameter of the disc 22 so that it can accommodate an ink receptacle or container 40. Thus, separation along scored lines or grooves 27*b* and 27*c* will reduce the diameter of disc 22 even further and therefore, reduce the area of marginal edge 24. It is important to note that the inner most scored line 27 (line 27*c* herein for example, although more than three (3) such scored lines can be formed in marginal annular edge 24) must always be outside of the diameter of disc 20 so that some marginal edge 24 will exist for without marginal annular edge 24 apparatus 10 has no receptacle sealing capability other than that offered by the marginal edge 61 of disc 20 which is inadequate to avoid hardening of the surface of the ink during storage.

The operation of apparatus 10 is best illustrated in FIG. 4. First a receptacle or container 40 of printers' ink 50 is opened. The inside diameter or "ID" of receptacle 40 is measured. Then the diameter of disc 22 is determined by that scored line 27 just larger than the inner diameter or "ID" of container 40. Then that portion of annular marginal edge 24 outside of the selected scored line 27 is removed. Grasping handle 12 the user imparts vertical movement to apparatus 10 in the direction of ARROWS A until the lower surface 23 of circular member 22 is positioned within receptacle 40 and engages the surface "S" of ink 50. Since the reduced marginal annular edge 24 defined by the selected scored line 27 is flexible it will bend, as best seen in FIG. 4, as disc 22 easily traverses container 40 and yet maintain a seal with interior wall 42 of receptacle 40. In this way ink 50 in receptacle 40 can be stored without the typical problem of the ink 50 hardening at its surface "S" due to exposure to air. When it is desired to remove ink 50 from receptacle 40 the user simply grasps handle 12 and imparts motion in the direction opposite ARROWS A. Ink can be removed in either of two (2) ways; first, if the lower surface 23 of disc 22 has an affinity for ink 50 (by inherent characteristics or applying a chemical coating thereto), then ink 50 will adhere to surface 23 after contact therewith and when disk 22 is removed from receptacle 40, ink 50 will also be removed; second, after sealing disc 22 is removed from receptacle 40, ink 50 can be poured into the desired reservoir.

While my applicator and receptacle sealer 10 is intended primarily for applying printers' ink 50 stored in a receptacle 40 of such ink and sealing such receptacle, it can be used with any container of a viscous liquid with a diameter within the range of adjustable diameters of disc 22.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. An applicator and receptacle sealing means for applying a viscous liquid stored in said receptacle and sealing said receptacle which is open at the top for removal of said liquid, said applicator and sealing means comprising:

(a) a substantially circular member of a flexible, semi-rigid material having means for selectively adjusting the diameter thereof and having a marginal annular edge for sealably engaging the interior wall of said receptacle, said means for selectively adjusting the diameter of said substantially circular member comprising means, provided annularly in said marginal annular edge, for removing a selected outer portion of said marginal annular edge from said substantially circular member, thereby reducing the diameter of said substantially circular member; and, (b) means mounted to said substantially circular member for imparting vertical movement thereto when said substantially circular member is positioned within said receptacle.

2. The applicator and sealing means of claim 1, wherein the lower surface of said substantially circular member has an affinity for said viscous liquid.

3. The applicator and sealing means of claim 1, wherein said means for removing the outer portion of said marginal annular edge comprises a plurality of annularly scored lines provided in said marginal annular edge, whereby said selected outer portion of said marginal annular edge is removed, thereby reducing the diameter of said substantially circular member.

4. The applicator and sealing means of claim 3, wherein said annularly scored lines are spaced apart concentrically in said marginal annular edge.

5. The applicator and sealing means of claim 1, wherein said means for imparting movement comprises a second substantially circular member and an elongated handle mounted to the upper surface of said second substantially circular member, said second substantially circular member being mounted on the upper surface of said first substantially circular member.

6. The applicator and sealing means of claim 5, wherein second substantially circular member is of diameter less than the smallest possible diameter of said first substantially circular member, thereby defining said marginal annular edge for sealably engaging the interior wall of said receptacle.

7. An applicator and receptacle sealing means for applying a viscous liquid stored in said receptacle and sealing said receptacle which is open at the top for removal of said liquid, said applicator and sealing means comprising:

(a) a substantially circular member of a flexible, semi-rigid material having means for selectively adjusting the diameter thereof and having a marginal annular edge for sealably engaging the interior wall of said receptacle, said means for selectively adjusting the diameter of said substantially circular member comprising means, provided annularly in said marginal annular edge, for removing a selected outer portion of said marginal annular edge from said substantially circular member, thereby reducing the diameter of said substantially circular member; and, (b) means mounted to the upper surface of said substantially circular member for imparting sealing vertical movement thereto when said substantially circular member is positioned within said receptacle.

8. The applicator and sealing means of claim 7, wherein the lower surface of said substantially circular member has an affinity for said viscous liquid.

9. The applicator and sealing means of claim 7, wherein said means for removing the outer portion of said marginal annular edge comprises a plurality of annularly scored lines provided in said marginal annular edge, whereby said selected outer portion of said marginal annular edge is removed, thereby reducing the diameter of said substantially circular member.

10. The applicator and sealing means of claim 9, wherein said annularly scored lines are spaced apart concentrically in said marginal annular edge.

11. The applicator and sealing means of claim 7, wherein said means for imparting movement comprises a second substantially circular member and an elongated handle mounted to the upper surface of said second circular member, said substantially second circular member being mounted on the upper surface of said first substantially circular member.

12. The applicator and sealing means of claim 11, wherein second substantially circular member is of diameter less than the smallest possible diameter of said first substantially circular member, thereby defining said marginal annular edge for sealably engaging the interior wall of said receptacle.

13. An applicator and receptacle sealing means for applying a viscous liquid stored in said receptacle and sealing said receptacle which is open at the top for removal of said liquid, said applicator and sealing means comprising:

(a) a first substantially circular member of a flexible, semi-rigid material having means for selectively adjusting the diameter thereof and having a marginal annular edge for sealably engaging the interior wall of said receptacle, said means for selectively adjusting the diameter of said substantially circular member comprising means, provided annularly in said marginal annular edge, for removing a selected outer portion of said marginal annular edge from said substantially circular member, thereby reducing the diameter of said substantially circular member, said means for removing the outer portion of said marginal annular edge comprising a plurality of concentrically spaced-apart and annularly scored lines provided in said marginal annular edge and, (b) means mounted to the upper surface of said substantially circular member for imparting vertical movement thereto when said substantially circular member is positioned within said receptacle, said means comprising a second substantially circular member of a diameter less than the smallest possible diameter of said first substantially circular member, thereby defining said marginal annular edge for sealably engaging the interior wall of said receptacle and an elongated handle mounted to the upper surface of said substantially circular member, said second substantially circular member being mounted on the upper surface of said first substantially circular member.

14. The applicator and sealing means of claim 13, wherein the lower surface of said substantially circular member has an affinity for said viscous liquid.

15. The applicator and sealing means of claim 13, wherein said material forming said substantially circular member is rubber.

* * * * *